US007466227B2

(12) United States Patent
Chen et al.

(10) Patent No.: US 7,466,227 B2
(45) Date of Patent: Dec. 16, 2008

(54) LOCATION BASED VEHICLE TRAFFIC SIGNAL ALERT SYSTEM

(75) Inventors: Yang Chen, Cary, NC (US); Ranjan Sharma, New Albany, OH (US); Shengqiang Wang, Cary, NC (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 320 days.

(21) Appl. No.: 11/378,443

(22) Filed: Mar. 17, 2006

(65) Prior Publication Data

US 2007/0222638 A1 Sep. 27, 2007

(51) Int. Cl.
*G08B 1/08* (2006.01)
*G08B 1/00* (2006.01)
*G08G 1/08* (2006.01)

(52) U.S. Cl. ..... 340/539.13; 340/539.1; 340/901; 340/904; 340/907; 340/933; 340/935; 701/70; 701/117; 701/119

(58) Field of Classification Search ..... None
See application file for complete search history.

(56) References Cited

U.S. PATENT DOCUMENTS

| | | | | |
|---|---|---|---|---|
| 2003/0016143 | A1* | 1/2003 | Ghazarian | 340/901 |
| 2003/0179106 | A1* | 9/2003 | Neff | 340/901 |
| 2004/0225434 | A1* | 11/2004 | Gotfried | 701/200 |
| 2005/0156757 | A1* | 7/2005 | Garner | 340/907 |
| 2006/0184312 | A1* | 8/2006 | Kiim | 701/117 |

* cited by examiner

*Primary Examiner*—Julie Lieu

(57) ABSTRACT

Embodiments of the location based vehicle traffic signal alert system, according to the present method and apparatus, may alert drivers as to when vehicles are approaching the traffic signal lights while the signal is yellow or red. In addition, it may also warn drivers when the signal ahead is about to change colors, for example, from green to yellow or from yellow to red. In an alternative embodiment the signal alert system may also send a signal to the engine/brake system of the automobile to perform automatic throttle control or braking when the driver fails to attempt a required stop at the traffic light.

20 Claims, 5 Drawing Sheets

LOCATION BASED VEHICLE TRAFFIC SIGNAL ALERT SYSTEM

TECHNICAL FIELD

The invention relates generally to communication systems and, more specifically, to a system that sends alerts to vehicles approaching a signal controlled intersection.

BACKGROUND

Wireless communication systems are constantly evolving and many applications can be built based on them. Systems may be designed using different technologies, such as radio frequency, infrared, etc. and different formats, such as, analog, digital, etc.

There are many types of traffic control systems. One typical element used in these systems is the traffic light. The traffic light may have many different configurations. In general, a traffic signal is a road signal for directing vehicular traffic by means of colored lights, typically red for stop, green for go, and yellow for proceed with caution. Of course, such devices only provide for safe traffic control when drivers obey these signals. Some drivers may not obey these signals, not because they do it deliberately, but because often they become distracted, for example. In other cases, certain roadway configurations make it difficult for drivers to clearly see the traffic lights.

Some roads are curved near intersections with other roads. This makes it difficult for a driver to see a traffic signal at the intersection until the driver is almost upon the intersection, even though a roadside "signal ahead" sign could warn some drivers, but it is not practical during the night, especially if the driver is new to the area. It is also common for some drivers to make phone calls or do something else while driving, which often results a driver missing or overlooking a traffic signal. The above-mentioned situations are major contributors to intersections of roads that are known to have significant fatal traffic accidents.

Thus, there is a need in the art for an improved traffic control system.

SUMMARY

One embodiment of the present method and apparatus encompasses an apparatus. In this embodiment the apparatus may comprise: a wireless signal message generator co-located with and operatively coupled to at least one traffic signal light; an on-board vehicle signal alert system having a wireless signal message receiver, a GPS (global positioning system) receiver that receives GPS signals, an alert service module operatively coupled to the wireless signal message receiver and to the GPS receiver; a signal message generator outputting to the wireless signal message receiver at least one traffic signal message indicative of a location of the traffic signal and a current light status of the at least one traffic signal; and an onboard alarm that is activated by the alert service module as a function of a received at least one traffic signal message and at least one received GPS signal.

Another embodiment of the present method and apparatus encompasses a method. This embodiment of the method may comprise: broadcasting a traffic signal message associated with at least one traffic signal light; receiving the traffic signal message by a vehicle, when the vehicle is approaching at least one traffic light, regardless of a moving direction of the vehicle; determining the speed and moving direction of the vehicle; and generating an alarm, as a function of information in the traffic signal message and the speed and direction of the vehicle, when the vehicle is approaching at least one traffic signal light.

DESCRIPTION OF THE DRAWINGS

Features of exemplary implementations of the invention will become apparent from the description, the claims, and the accompanying drawings in which:

DETAILED DESCRIPTION

Embodiments of the location based vehicle traffic signal alert system, according to the present method and apparatus, may alert drivers when vehicles are approaching the traffic signal lights while the signal is yellow or red. In addition, it may also warn drivers when the signal ahead is about to change colors, for example, from green to yellow or from yellow to red. In an alternative embodiment the signal alert system may also send a signal to the engine/brake system of the automobile to perform automatic throttle control or braking when the driver fails to attempt a required stop at the traffic light.

In general terms embodiments of the present method and apparatus may have a location based vehicle traffic signal alert system, which may consist of a wireless signal message generator co-located with traffic signal lights and an on-board vehicle signal alert system that may include a wireless signal message receiver, a GPS receiver and an alert service. The signal message generator may periodically or continuously send out traffic signal messages, which may contain the information in this embodiment that includes the latitude and longitude of the position of the traffic light and the directions of the yellow or red traffic signals. For example, the direction may be, but not limited to, a coming from north, a coming from south, a coming from south-west, etc. For a turn-left and a turn-right yellow or red lights, no signal message may be sent out. When a vehicle is approaching the traffic signal light, and is, for example, 100 yards from the light, the vehicle may start to receive the signal messages. The on-board traffic signal receiver may receive the information of the latitude and longitude of the signal light position and the directions of yellow or red lights. The GPS receiver may obtain the location information of the vehicle and the alert service may then calculate the vehicle speed and vehicle moving direction. When the direction in the traffic signal message matches the vehicle moving direction and the vehicle speed is not zero, the on-board signal alert system generates an alarm to warn the driver. The signal message generator may also generate different signals when the signal ahead is about to turn colors (from green to yellow or from yellow to red) so the drivers can be warned.

Figure 1:
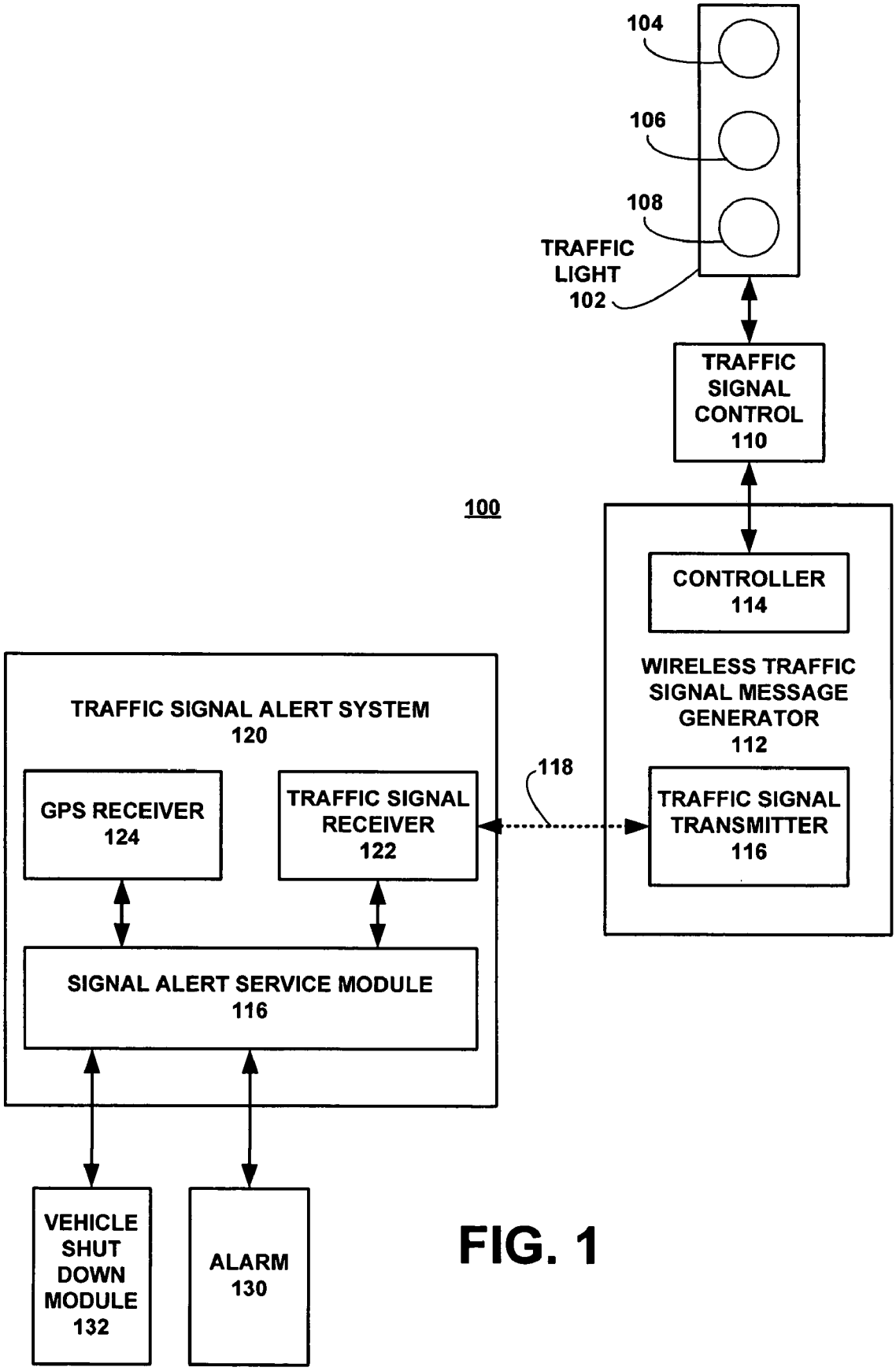
FIG. 1 is a representation of one implementation of an apparatus that provides a system 100 for alerting drivers of vehicles, which are approaching an intersection, as to the current traffic light configuration.

FIG. 1 is a representation of one implementation of an apparatus that provides a system 100 for alerting drivers of vehicles, which are approaching an intersection, as to the current traffic light configuration. The system 100 may have at least one traffic light 102, which may have, for example red lights 104, yellow lights 106 and green lights 108. An intersection of roadways may have a plurality of traffic lights in various configurations. The traffic lights may also have light-up arrows, for example, as well as standard colored lights.

The traffic light 102 may be operatively coupled to a traffic signal control 110 that operates the lights 104, 106, 108 in the traffic light 102. The traffic signal control 110 typically cycles the lights 104, 106, 108 in the traffic light 102 through various pre-set patterns. A wireless traffic signal message generator 112 may be operatively coupled to the traffic signal control 110. The message generator 112 may have a controller 114 that monitors and derives a current status of the traffic light 102 from the traffic signal control 110. The controller 114 may be operatively coupled to a transmitter 116 that may emit for example radio frequency signals 118 containing information indicative of the current status of the traffic light 102.

The radio frequency signals 118 may be received by a traffic signal alert system 120 that is installed in a vehicle (not shown). The traffic signal alert system 120 may have a receiver 122 for receiving the radio frequency signals 118 while the vehicle is in a predetermined range of the transmitter 116 associated with the traffic signal 102. The range may be determined by the geography and configuration of the roadways, by the typical speed of vehicles approaching the traffic signal, and by the density of traffic, etc. For example, in one embodiment where vehicles are traveling 55 mph to 70 mph, at the minimum, a range of 125 feet to 200 feet may be utilized. This allows adequate distance for a vehicle to stop after receiving an alert signal. As should be obvious here, the range of the signal is dependent on the permissible speed limit on the road. However, an adequate buffer should be added, so speeding drivers also get enough warning, icy road conditions can be accounted for and also, drivers slow to react to the warning signal can still manage to safely stop the vehicle.

The traffic signal alert system 120 may also have a GPS receiver 124 that outputs a special position of the vehicle. The traffic signal alert system 120 may further have a signal alert service module 116 that formulates an alert signal, via an alarm 130, based on information that is output from the GPS receiver 124 and the traffic signal receiver 122.

The traffic signal alert system 120 may further have a shut down module 132 that is operatively coupled to the signal alert service module 116 in the vehicle. The traffic signal alert system 120 activates the shut down module 132 to send a signal to an engine/brake system of the vehicle to perform at least one of automatic throttle control and braking, when a driver of the vehicle fails to attempt a required stop at the traffic light in response to the alarm. It should be obvious that emergency vehicles and law enforcement vehicles would exercise override control over the alert system and are, in general, not the audience for this proposal.

Figure 2:
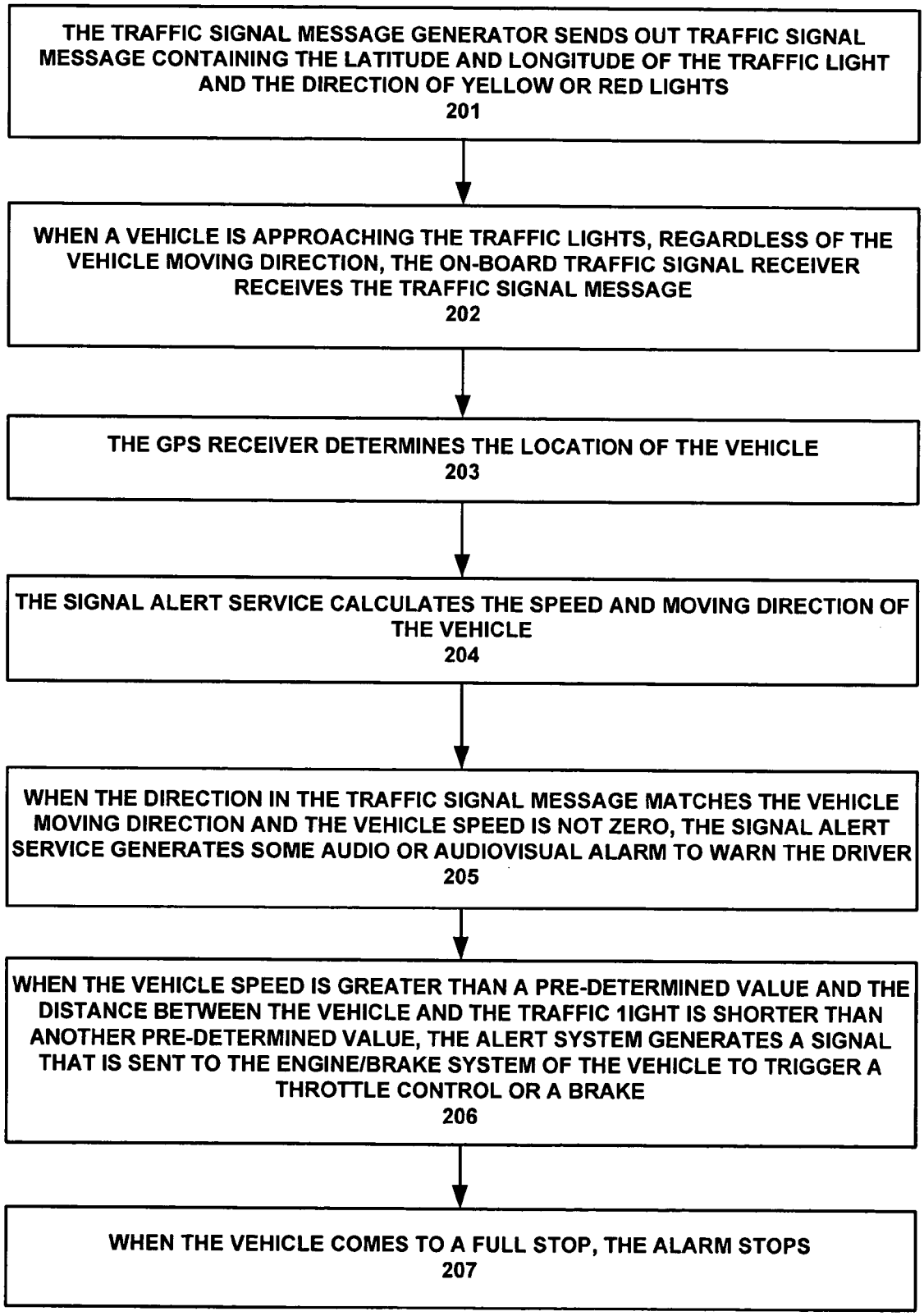
FIG. 2 depicts one embodiment of the present method that may be utilized with the FIG. 1 system.

FIG. 2 depicts one embodiment of the present method that may be utilized with the FIG. 1 system, for example. This embodiment of the present method may have the following steps:

The traffic signal message generator sends out traffic signal message containing the latitude and longitude of the traffic light and the direction of yellow or red lights (step 201).

When a vehicle is approaching the traffic lights, regardless of the vehicle's moving direction, the on-board traffic signal receiver receives the traffic signal message (step 202).

The GPS receiver determines the location of the vehicle (step 203).

The signal alert service calculates the speed and moving direction of the vehicle (step 204).

When the direction in the traffic signal message matches the vehicle's moving direction and the vehicle speed is not zero, the signal alert service generates audio or audiovisual alarm to warn the driver (step 205). This alarm continues until the driver takes corrective action (such as, slowing down or completely stopping the vehicle). It is possible for the alarm intensity to increase over a period of time, such as when the driver has not reacting to the alarm over a passage of time, or the driver has increased the speed of the vehicle etc.

When the vehicle speed is greater than a pre-determined value, say 20 miles per hour, and the distance between the vehicle and the traffic light is shorter than another pre-determined value, for example 12 feet, the alert system generates a signal that is sent to the engine/brake system of the vehicle to trigger a throttle control or a brake (step 206).

When the vehicle comes to a full stop, the alarm stops (step 207).

There may be one signal generator for each traffic light, or one signal generator that outputs a plurality of signals respectively for a plurality of traffic lights. Also, messages may be different for different directions that the vehicle moves to and for different directional orientation of the traffic light(s). Each message contains the latitude and longitude of the position of the traffic light and the directions of the yellow or red traffic signals. Which message is to be used may be determined by information from the GPS unit in the vehicle. Thus, in these embodiments all traffic messages are continuously broadcast from the traffic light. It is the traffic signal alert system in the vehicle that determines which traffic messages to utilize and which traffic messages to disregard.

The alarm in the vehicle may be an audible tone or signal that may be played through the audio system of the vehicle or through a separate speaker. The alarm may also be a warning light, or even displayed in a vehicles having a heads up display. Embodiments of the present method and apparatus may use alarms of various types. When generating an audio alarm, the system may preempt the vehicle audio system. For example, when there is loud music playing in the vehicle, the alert system will minimize or stop the music so that the alarm sound can be heard. The alarm intensity may be used an indication of proximity of the vehicle to the traffic stop.

Figure 3:
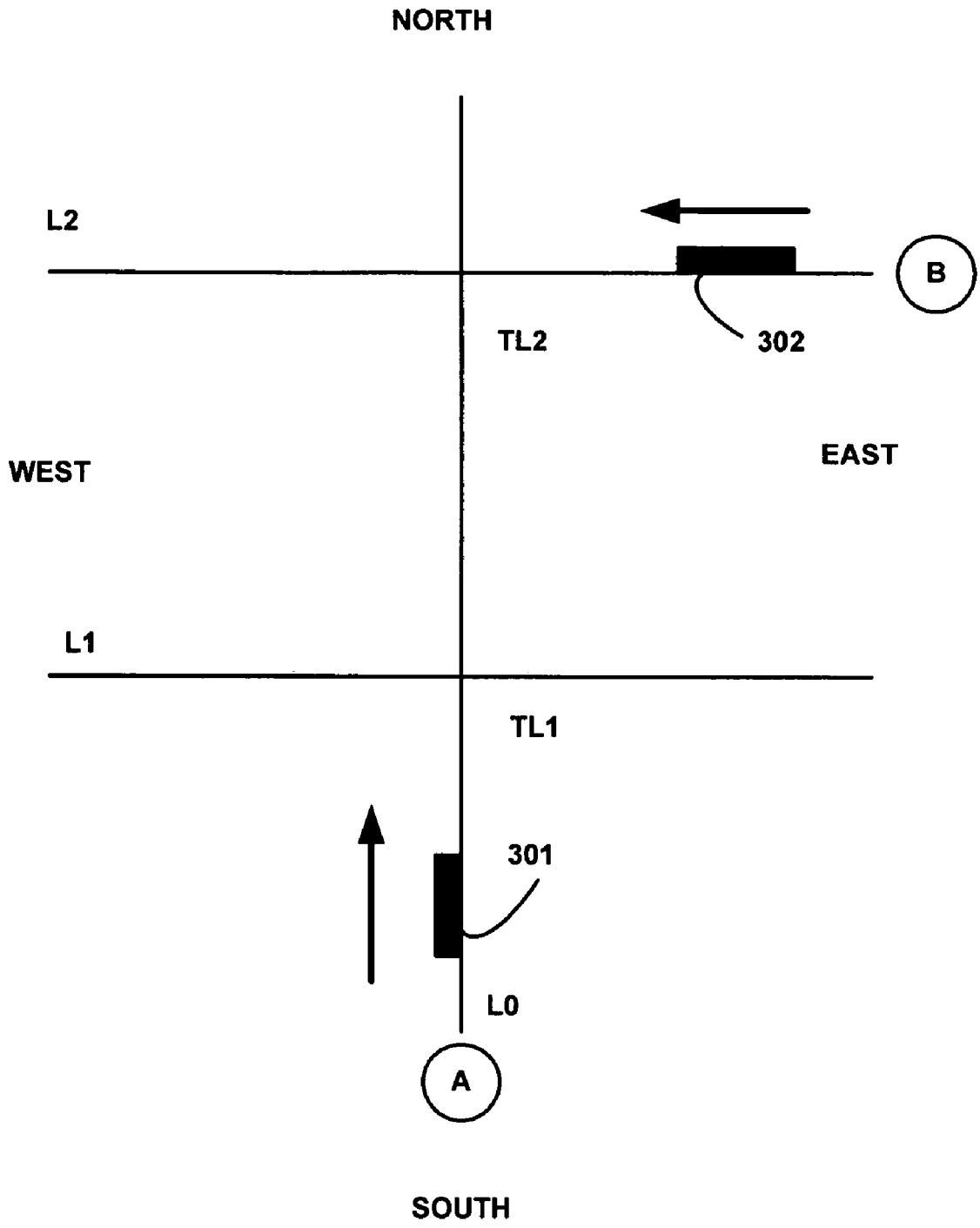
FIG. 3 depicts an example of an adjacent traffic lights configuration.

FIG. 3 depicts an example of an adjacent traffic lights configuration. In this configuration roads L1 and L2 cross road L0.

The vehicle 301 is coming from point A from South to North along road L0. Traffic lights TL1 and TL2 are adjacent to each other. The on-board traffic signal alert system in vehicle 301 will receive signals from both traffic lights TL1 and TL2 and make decisions with respect to each of the traffic lights. The alarm may be generated when at least one traffic light meets the alarm generating criteria. Thus, for example, if traffic light TL1 is red and TL2 is green an alarm will sound in vehicle 301; if traffic light TL2 is red and TL1 is green an alarm will sound in vehicle 301; if traffic light TL1 is red and TL2 is red an alarm will sound in vehicle 301; and if traffic light TL1 is green and TL2 is green no alarm will sound in vehicle 301.

The vehicle 302 is coming from point B from East to West along road L2. Traffic lights L1 and L2 are adjacent to each other. The on-board traffic signal alert system in vehicle 302 will receive signals from both traffic lights TL1 and TL2. The on-board traffic signal alert system in vehicle 302 may calculate the shortest distance from the vehicle 302 to the road L1 and L2. Therefore, the on-board traffic signal alert system will know which traffic signal it should consider. In this example, traffic light TL1 will be ignored as long as vehicle 302 does not turn south at the intersection.

Figure 4:
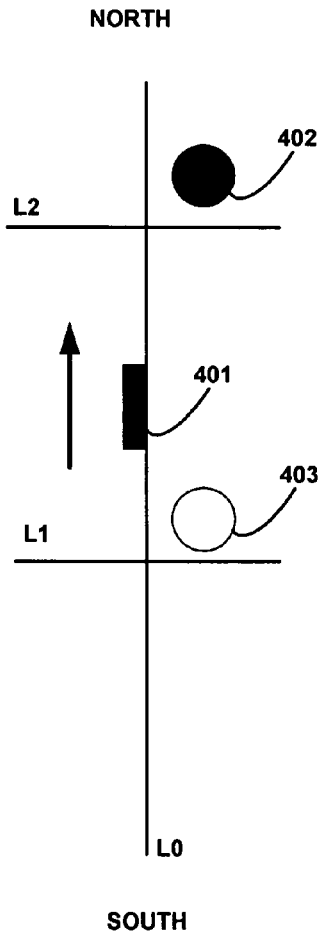
FIG. 4 depicts an example of another adjacent traffic lights configuration.

FIG. 4 depicts an example of another adjacent traffic lights configuration. In this configuration roads L1 and L2 cross road L0.

In this embodiment, the receiver in the vehicle 401 will get two signals; one from the traffic signal with the red light 402 in front and one dispersed signal from the traffic signal with the green light 403 behind it. How will it sort this out? In this case, the green light 403 and red light 402 are for vehicles coming from the south. For the green light 403, as the vehicle is heading to the north, the signal for the green light 403 is ignored by the on-board signal alert system. For the red light 402, as the vehicle 401 is coming from the south, the signal for the red signal 402 will be considered by the on-board signal alert system.

Figure 5:
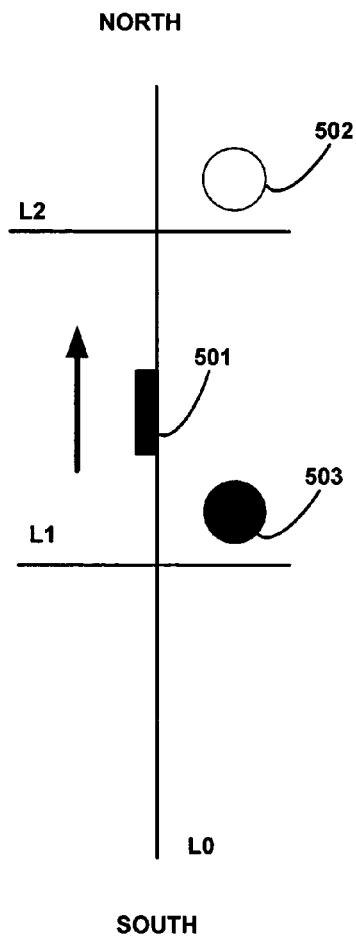
FIG. 5 depicts an example of a further traffic lights configuration.

FIG. 5 depicts an example of a further traffic lights configuration. In this configuration roads L1 and L2 cross road L0.

In this embodiment, the receiver in the vehicle 501 will get two signals; one from the traffic signal with the green light 502 in front and one dispersed signal from the traffic signal with the red light 503 behind it. How will it sort this out? In this case, the green light 502 and red light 503 are for vehicles coming from the south. For the red light 503, as the vehicle 501 is leaving to the north, the signal for the red light 503 is therefore ignored by the on-board signal alert system. For the green light 502 and since the vehicle 501 is coming from the south, the signal for the green light 502 will be considered by the on-board signal alert system, but since it is green, no alarm will be generated.

The above approach depicted in FIGS. 4 and 5 works as long as the vehicle is moving. However, when the vehicle is fully stopped, the vehicle's moving direction can not be determined. However, as the vehicle is fully stopped in this case, no signal alert is needed.

Figure 6:
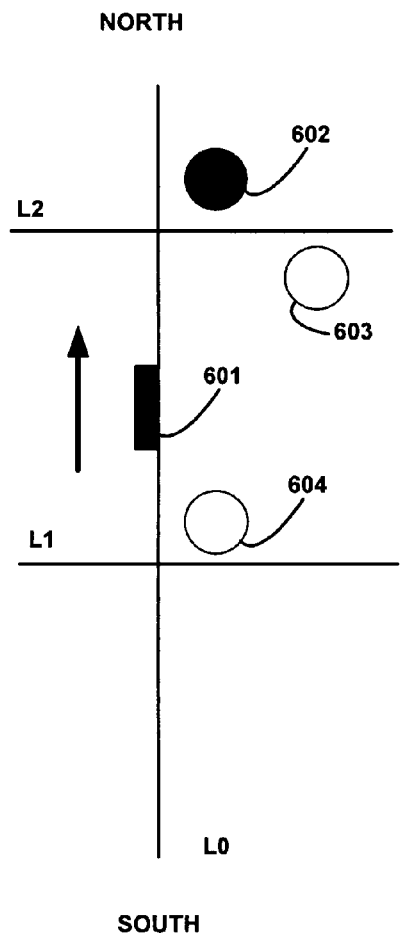
FIG. 6 depicts an example of yet another adjacent traffic lights configuration.

FIG. 6 depicts an example of yet another adjacent traffic lights configuration. In this configuration roads L1 and L2 cross road L0.

In this case, the vehicle 601 is at an equal distance from the two traffic lights 602 and 603 ahead; and the two traffic lights 602 and 603 are in two different modes. In this case, the green light 603 ahead is for vehicles coming from the east along road L2, and the red light 602 ahead is for vehicles coming from the south. When the vehicle 601 is moving from south to north, the onboard signal alert system will only consider the red light 602 and generate the alarm if the criteria are met. Once the vehicle changes its direction to head east, the red light 602 will be ignored by the on-board signal alert system and only the green light 603 will be considered, and thus since it is green, no alarm will be generated.

Figure 7:
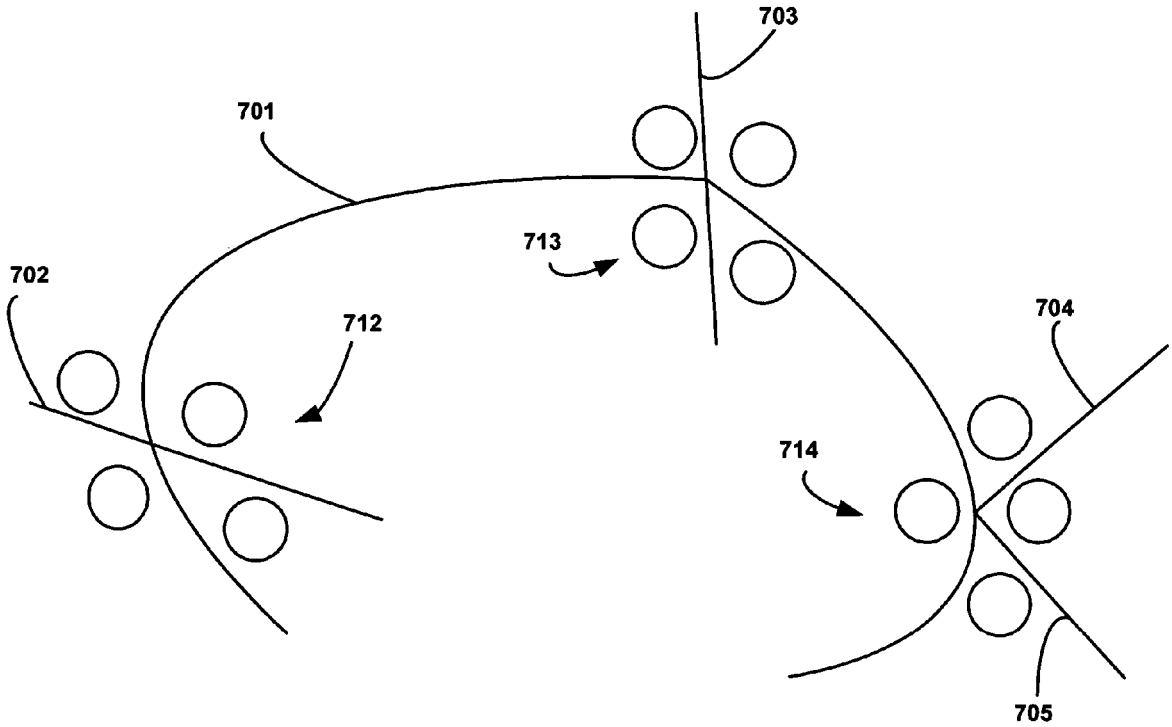
FIG. 7 depicts an example of another traffic lights configuration.

FIG. 7 depicts another example of a traffic light configuration.

In this situation, all three traffic light complexes 712, 713, 714 may be in a close vicinity, say within 100 yards of one another. This challenges both the traffic signal message interference and the GPS location accuracy of about 5-30 meters. However, in this case, it is unlikely that vehicles moving along the circle road 701 or coming out of the circle road 701 are traveling at a high speed. In addition, drivers of these vehicles usually pay extra attention as the traffic situation is complex. Therefore, for traffic moving along the circle road 701 and coming out of the circle road 701, traffic signal messages are not needed and hence not generated. On the other hand, vehicles coming from outside of the circle road 701 along roads 702, 703, 704, 705 may be traveling at a high speed, and traffic signal messages should be generated for the traffic coming from outside the circle road 701.

For the intersection with curved roads, if there are no close adjacent intersections, the traffic signal messages may be generated as simple traffic pattern that tends to encourage the higher speed of vehicles. However, the situation is fairly a rare traffic pattern.

The present apparatus in one example may comprise a plurality of components such as one or more of electronic components, hardware components, and computer software components. A number of such components may be combined or divided in the apparatus.

The present apparatus in one example may employ one or more computer-readable signal-bearing media. The computer-readable signal-bearing media may store software, firmware and/or assembly language for performing one or more portions of one or more embodiments. The computer-readable signal-bearing medium in one example may comprise one or more of a magnetic, electrical, optical, biological, and atomic data storage medium. For example, the computer-readable signal-bearing medium may comprise floppy disks, magnetic tapes, CD-ROMs, DVD-ROMs, hard disk drives, and electronic memory.

The steps or operations described herein are just exemplary. There may be many variations to these steps or operations without departing from the spirit of the invention. For instance, the steps may be performed in a differing order, or steps may be added, deleted, or modified.

Although exemplary implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

We claim:

1. An apparatus, comprising:

a wireless signal message generator co-located with and operatively coupled to at least one traffic signal light;

an on-board vehicle signal alert system having a wireless signal message receiver, a GPS receiver that receives GPS (global positioning system) signals, and an alert service module operatively coupled to the wireless signal message receiver and to the GPS receiver;

the signal message generator outputting to the wireless signal message receiver at least one traffic signal message indicative of a location of the traffic signal and a current light status of the at least one traffic signal; and an onboard alarm that is activated by the alert service module as a function of a received at least one traffic signal message and at least one received GPS signal; and the wireless signal message generator having a predetermined broadcast range, which is predetermined as a function of the location of the traffic signal light and velocities of vehicles relative to the at least one traffic signal light.

2. The apparatus according to claim 1, wherein the traffic signal message comprises four messages containing a latitude and longitude of a position of the traffic light and current directions of yellow or red lights of the at least one traffic signal.

3. The apparatus according to claim 1, wherein the alert service module calculates a vehicle speed and vehicle moving direction, and wherein, when a direction in the traffic signal message matches the vehicle moving direction and when the vehicle speed is greater than zero, the signal alert system activates the onboard alarm.

4. The apparatus according to claim 1, wherein the alarm is at least one of an audible alarm and a visual alarm.

5. The apparatus according to claim 1, wherein the apparatus further comprises a shut down module operatively coupled to the alert service module that is operatively coupled to a vehicle, and wherein the signal alert system activates the shut down module to send a signal to an engine/brake system of the vehicle to perform at least one of automatic throttle control and braking, when a driver of the vehicle fails to attempt a required stop at the traffic light in response to the alarm.

6. A method, comprising:

sending, by a traffic signal message generator, a traffic signal message associated with at least one traffic signal light;

receiving, by an on-board traffic signal receiver in a vehicle, the traffic signal message, when the vehicle is approaching the at least one traffic light, regardless of a moving direction of the vehicle;

determining, via GPS (global positioning system), a location of the vehicle;

calculating, by a signal alert service module in the vehicle, a speed and moving direction of the vehicle; and generating, when a direction in the traffic signal message matches the vehicle moving direction and when the vehicle speed is not zero, an alarm; and the traffic signal message generator having a predetermined broadcast range, which is predetermined as a function of the location of the traffic signal light and from velocities of vehicles relative to the at least one traffic signal light.

7. The method according to claim 6, wherein traffic signal message contains the latitude and longitude of the traffic light and the direction of yellow or red lights of the at least one traffic signal light.

8. The method according to claim 6, wherein, when the vehicle speed is greater than a first predetermined value, and wherein a distance between the vehicle and the at least one traffic signal light is less than a second predetermined value, and wherein the alert system generates a signal that is sent to a engine/brake system of the vehicle to trigger at least one of a throttle control and a brake of the vehicle.

9. The method according to claim 8, wherein the first predetermined value is approximately 20 miles per hour, and wherein the second predetermined value is approximately 10 feet.

10. The method according to claim 6, wherein the method further comprises stopping the alarm when the vehicle comes to a full stop.

11. The method according to claim 6, wherein the traffic signal message comprises four messages containing a latitude and longitude of a position of the traffic light and current directions of yellow or red lights of the at least one traffic signal.

12. The method according to claim 6, wherein the method further comprises calculating a vehicle speed and vehicle moving direction, and wherein, when a direction in the traffic signal message matches the vehicle moving direction and when the vehicle speed is greater than zero, the signal alert system activates the onboard alarm.

13. The method according to claim 12, wherein the alarm is at least one of an audible alarm and a visual alarm.

14. The method according to claim 6, wherein the method further comprises sending a signal to an engine/brake system of the vehicle to perform at least one of automatic throttle control and braking, when a driver of the vehicle fails to attempt a required stop at the traffic light in response to the alarm.

15. A method, comprising:

broadcasting a traffic signal message associated with at least one traffic signal light;

receiving the traffic signal message by a vehicle, when the vehicle is approaching the at least one traffic light, regardless of a moving direction of the vehicle;

determining speed and moving direction of the vehicle; and generating an alarm, as a function of information in the traffic signal message and the speed and direction of the vehicle, when the vehicle is approaching the at least one traffic signal light;

wherein the traffic signal message is broadcast over a predetermined broadcast range, which is predetermined as a function of a location of the traffic signal light and from velocities of vehicles relative to the at least one traffic signal light.

16. The method according to claim 15, wherein the method further comprises determining a location of the vehicle via GPS (global positioning system), and calculating the speed and moving direction of the vehicle.

17. The method according to claim 15, wherein, when the vehicle speed is greater than a first predetermined value, and when a distance between the vehicle and the at least one traffic signal light is less than a second predetermined value, the alert system generates a signal that is sent to a engine/brake system of the vehicle to trigger at least one of a throttle control and a brake of the vehicle.

18. The method according to claim 17, wherein the first predetermined value is approximately 20 miles per hour, and wherein the second predetermined value is approximately 10 feet.

19. The method according to claim 15, wherein the method further comprises calculating a vehicle speed and vehicle moving direction, and wherein, when a direction in the traffic signal message matches the vehicle moving direction and when the vehicle speed is greater than zero, the signal alert system activates the onboard alarm.

20. The method according to claim 19, wherein the alarm is at least one of an audible alarm and a visual alarm.

* * * * *